US010737509B2

(12) United States Patent
Kearns et al.

(10) Patent No.: US 10,737,509 B2
(45) Date of Patent: Aug. 11, 2020

(54) PRINTING WITH MOISTURE PROFILES

(71) Applicant: Hewlett-Packard Development Company, L.P., Houston, TX (US)

(72) Inventors: James Kearns, Corvallis, OR (US); Aurelio Maruggi, San Diego, CA (US); George C. Ross, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/096,592

(22) PCT Filed: Jun. 30, 2016

(86) PCT No.: PCT/US2016/040360
§ 371 (c)(1),
(2) Date: Oct. 25, 2018

(87) PCT Pub. No.: WO2018/004595
PCT Pub. Date: Jan. 4, 2018

(65) Prior Publication Data

US 2019/0134994 A1 May 9, 2019

(51) Int. Cl.

| | |
|---|---|
| ***B41J 3/60*** | (2006.01) |
| ***B41J 11/00*** | (2006.01) |
| ***F26B 3/04*** | (2006.01) |
| ***F26B 3/28*** | (2006.01) |

(Continued)

(52) U.S. Cl.
CPC ..... *B41J 3/60* (2013.01); *B41J 11/002* (2013.01); *F26B 3/04* (2013.01); *F26B 3/283* (2013.01); *F26B 13/08* (2013.01); *F26B 21/004* (2013.01)

(58) Field of Classification Search
None
See application file for complete search history.

(56) References Cited

U.S. PATENT DOCUMENTS

| | | | |
|---|---|---|---|
| 4,881,182 | A | 11/1989 | Hank et al. |
| 6,584,703 | B1 | 7/2003 | Maenpaa et al. |
| 6,913,354 | B2 | 7/2005 | Rasmussen et al. |

(Continued)

FOREIGN PATENT DOCUMENTS

| | | |
|---|---|---|
| CN | 1883956 | 12/2006 |
| CN | 102407663 | 4/2012 |

(Continued)

OTHER PUBLICATIONS

HP PageWide Enterprise Color 556 printer series HP PageWide Enterprise Color MFP 586 series, Feb. 2016, < http://www8.hp.com/h20195/v2/GetPDF.aspx/4AA6-4208EEW.pdf >.

*Primary Examiner* — Erica S Lin
(74) *Attorney, Agent, or Firm* — HP Inc. Patent Department

(57) ABSTRACT

Provided in one example is a method. The method includes generating, using a processor, data of a negative of an image to be printed on a print medium. The method includes determining, using the processor, a moisture profile of a print job, which print job includes the image and the negative, using data of the image and the data of the negative. The method includes generating, using the processor, printing instructions of the print job using at least the determined moisture profile. The method includes printing the print job on the print medium using at least the printing instructions.

20 Claims, 8 Drawing Sheets

(51) Int. Cl.
*F26B 13/08* (2006.01)
*F26B 21/00* (2006.01)

(56) References Cited

U.S. PATENT DOCUMENTS

| | | | | |
|---|---|---|---|---|
| 7,575,315 | B2 | 8/2009 | Williams et al. | |
| 2004/0041892 | A1* | 3/2004 | Yoneyama | B41J 11/002 347/102 |
| 2006/0238592 | A1 | 10/2006 | Kadomatsu et al. | |
| 2007/0216742 | A1* | 9/2007 | Sarkisian | C09D 11/30 347/100 |
| 2007/0285456 | A1* | 12/2007 | Takasu | B41J 2/04553 347/19 |
| 2009/0185019 | A1* | 7/2009 | Ogasawara | B41J 2/2114 347/100 |
| 2012/0050433 | A1 | 3/2012 | Fujikura et al. | |
| 2012/0113205 | A1 | 5/2012 | Link | |
| 2014/0015878 | A1* | 1/2014 | Marcus | B41J 2/04 347/9 |
| 2014/0204158 | A1* | 7/2014 | Emamjomeh | B41J 11/0015 347/102 |

FOREIGN PATENT DOCUMENTS

| | | | |
|---|---|---|---|
| CN | 203344496 | U | 12/2013 |
| CN | 204095296 | U | 1/2015 |
| CN | 105473336 | | 4/2016 |
| EP | 2228226 | | 9/2010 |
| GB | 2353761 | A | 9/2000 |
| JP | 2005212371 | | 8/2005 |
| JP | 2012206354 | A | 10/2012 |
| JP | 2015016669 | | 1/2015 |
| WO | WO-2014047513 | A2 | 5/2014 |

* cited by examiner

1/8

PRINTING WITH MOISTURE PROFILES

BACKGROUND

A fluid-ejection device is a type of device that dispenses fluid in a controlled manner. For example, one type of fluid-ejection device is an inkjet-printing device, in which ink is ejected onto media to form an image on the print media. Furthermore, a roller-based fluid-ejection device includes printheads that eject fluid onto media as the media moves past a series of rollers. One type of printing system may print and dry images on a web of medium.

BRIEF DESCRIPTION OF THE DRAWINGS

The drawings are provided to illustrate various examples of the subject matter described herein in this disclosure (hereinafter "herein" for short, unless explicitly stated otherwise) related to printing with moisture profiles and are not intended to limit the scope of the subject matter. The drawings are not necessarily to scale.

The same part numbers designate the same or similar parts throughout the figures.

DETAILED DESCRIPTION

Figure 1:
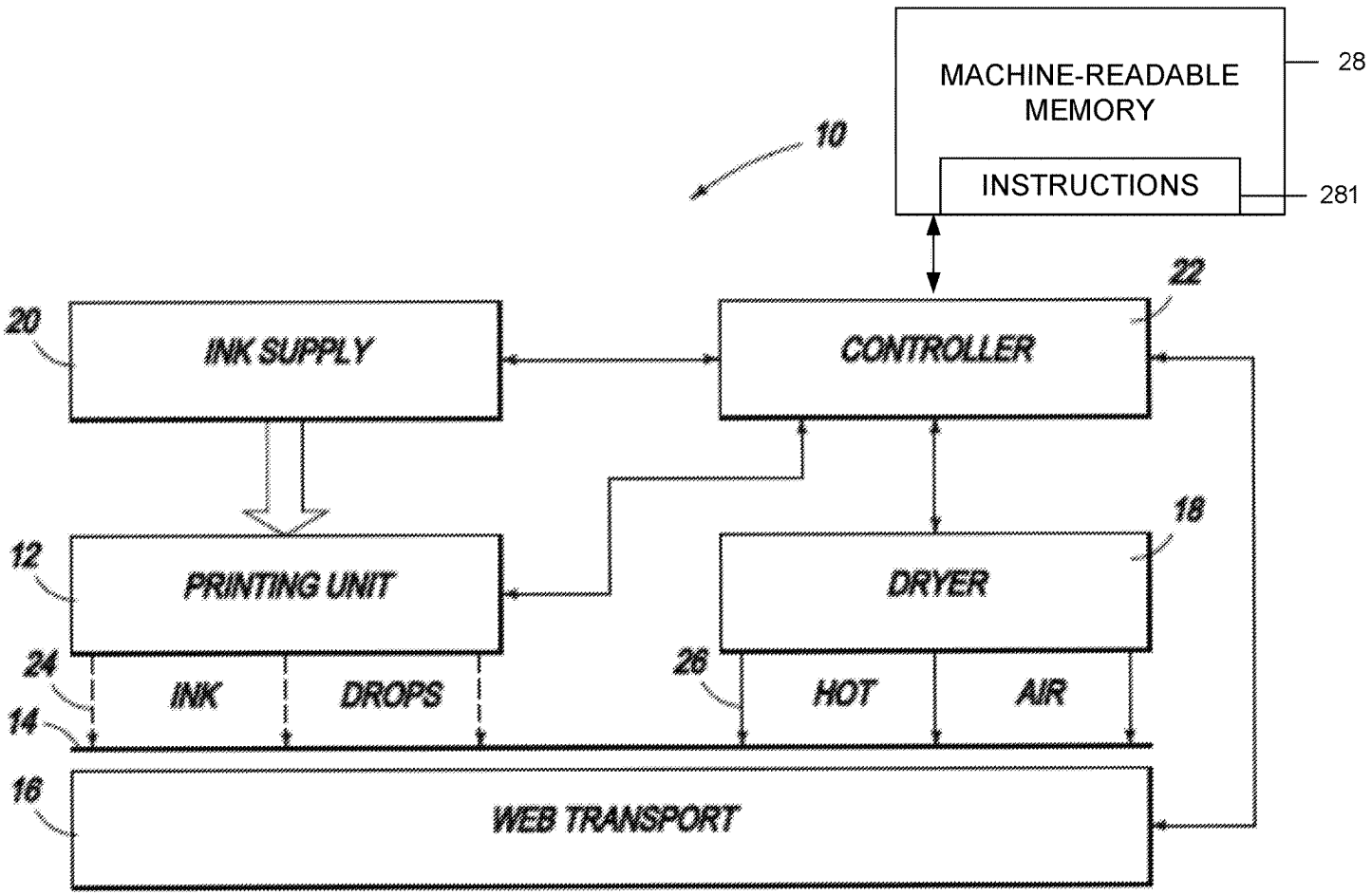
FIG. 1 is a schematic block diagram illustrating one example of a system described herein.

Digital inkjet web printers, in some instances referred to as inkjet web presses, are commercially available for industrial and commercial printing. HP Inc., USA, for example, has available the HP Inkjet Web Press for high production commercial inkjet printing. In one example of the HP Inkjet Web Press, the first side of the web is printed and dried at a first printing station, the web is inverted, and then the second side is printed and dried at a second printing station positioned end-to-end with the first printing station.

Aqueous based inkjet printing may add a relatively large amount of moisture to the print medium substrate, but only in the printed area. In many instances, to fully (or at least sufficiently) dry the printed area, the unprinted area ends up being over-dried, thereby resulting in a moisture differential. In some examples, the unprinted area moisture may be up to and sometimes more than about 2 wt % less than the printed area. In many instances, it is desirable to have a uniform moisture level across the web in corrugation processes to assure bond strength between flutes and liner and to control board warp. In one example, desired uniformity from the corrugators is about ±0.5 wt %.

The non-uniform moisture application from inkjet printing may create some paper handling issues. In one example, when moisture is added to the paper, the moisture causes expansion due to fiber growth and relaxation of bonds. In one case where the addition of moisture is physically constrained, as in a heavy fill bounded by a picture frame of dry media that is not similarly expanding, waves (cockle) may form in the print medium, often down web. Wrinkles and creases in the web may be formed when the medium expansion transitions over rollers under tension.

In one example, drying is the largest power draw on the inkjet press, involving tens to low hundreds of kilowatts. With a uniform moisture content across the web, relatively more moisture may be retained in the web and thus less drying is needed. Pre-existing methods to achieve this goal often involve optimization of web handling and drying. In one example, spreading types of rollers are used. In the case of drying, some applications (such as Kodak Prosper) use drying between applications of some ink planes. This may result in significant dimensional changes due to growth, shrinkage, and the resulting hysteresis that make color to color alignment difficult.

In view of the aforementioned challenges related to shape change during drying, the Inventors have recognized and appreciated the advantages of printing using moisture profiles. Following below are more detailed descriptions of various examples related to printing apparatuses and methods, particularly those involving printing using moisture profiles. The various examples described herein may be implemented in any of numerous ways.

Provided in one aspect of the examples is a method, comprising: generating, using a processor, data of a negative of an image to be printed on a print medium; determining, using the processor, a moisture profile of a print job, which print job comprises the image and the negative, using data of the image and the data of the negative; generating, using the processor, printing instructions of the print job using at least the determined moisture profile; and printing the print job on the print medium using at least the printing instructions Provided in another aspect of the examples is a method, comprising: generating, using a processor, printing instructions of a print job, which instructions involve a moisture profile of an image to be printed on a print medium and a negative of the image; disposing, using the printing instructions, a moisturizing agent over a first portion of the print medium to form the negative; and disposing, using the printing instructions, an ink composition over a second portion of the print medium to form the image Provided in another aspect of the examples is a printing device, comprising: a printing component having at least one series of print bars arranged along an arc of the printing component, at least one of the remaining print bars is to dispense a moisturizing agent and at least one of the print bar is to dispense an ink composition; a dryer; and a plurality of web guides each having a long axis oriented parallel to the long axis of each of the other web guides, the web guides arranged to guide the web along a duplex printing path past the first series of print bars for printing on a first side of the web, then through the dryer for drying the first side of the web, then past the second series of print bars for printing on a second side of the web, and then through the dryer for drying the second side of the web.

To the extent applicable, the terms "first," "second," "third," etc. herein are merely employed to show the respective objects described by these terms as separate entities and are not meant to connote a sense of chronological order, unless stated explicitly otherwise herein.

Provided in some examples herein includes a smaller footprint inkjet web press. Examples of the new web press described herein may offer relatively high quality, duplex web printing while minimizing, or even avoiding, the challenges of a vertical stack web press. While the term "printer" is used in several instances herein, the term is meant only as a non-limiting example of a device that is capable of printing—i.e., a "printing device."

The term "footprint" here refers to the area covered by a part; "print bar" to an inkjet pen or other inkjet printhead unit for dispensing ink drops across a web; and "web" to a continuous sheet of printable medium.

Print Device

FIG. 1 is a block diagram illustrating one example of a system 10 described herein. The system may be device for printing. Only for the sake of illustration, a printer, such as a web press inkjet printer, is employed as an example to describe the system 10 herein. It is appreciated that such a printer is only an illustrative example. The system may include a printing component 12 spanning the width of a web 14, a media transport mechanism 16, a dryer 18, an ink supply 20, and an electronic controller 22. In some instances, as shown in FIG. 1 but not always be the case, the system may comprise a machine-readable memory 28, which may contain thereon machine-readable instructions 281. As described in more detail below with reference to FIGS. 2 and 3, printing component 12 may include a series of print bars arranged in an arch with each print bar containing, for example, an array of ink pens each carrying at least one printhead die and the associated mechanical and electrical components for dispensing ink drops 24 on to web 14. Also, as described in more detail below with reference to FIGS. 2 and 3, dryer 18 may include, for example, a series of perforated tubes for directing hot air 26 onto web 14. Controller 22 represents generally the programming, processors, and associated memories, and the electronic circuitry and components needed to control the operative elements of a printer 10. Due to the large amount of data and signal processing often involved in an inkjet web press, controller 22 may include servers and computer work stations, as well as central processing units (CPUs) and associated memories (RAM and hard drives for example) and application specific integrated circuits (ASICs).

Figure 2:
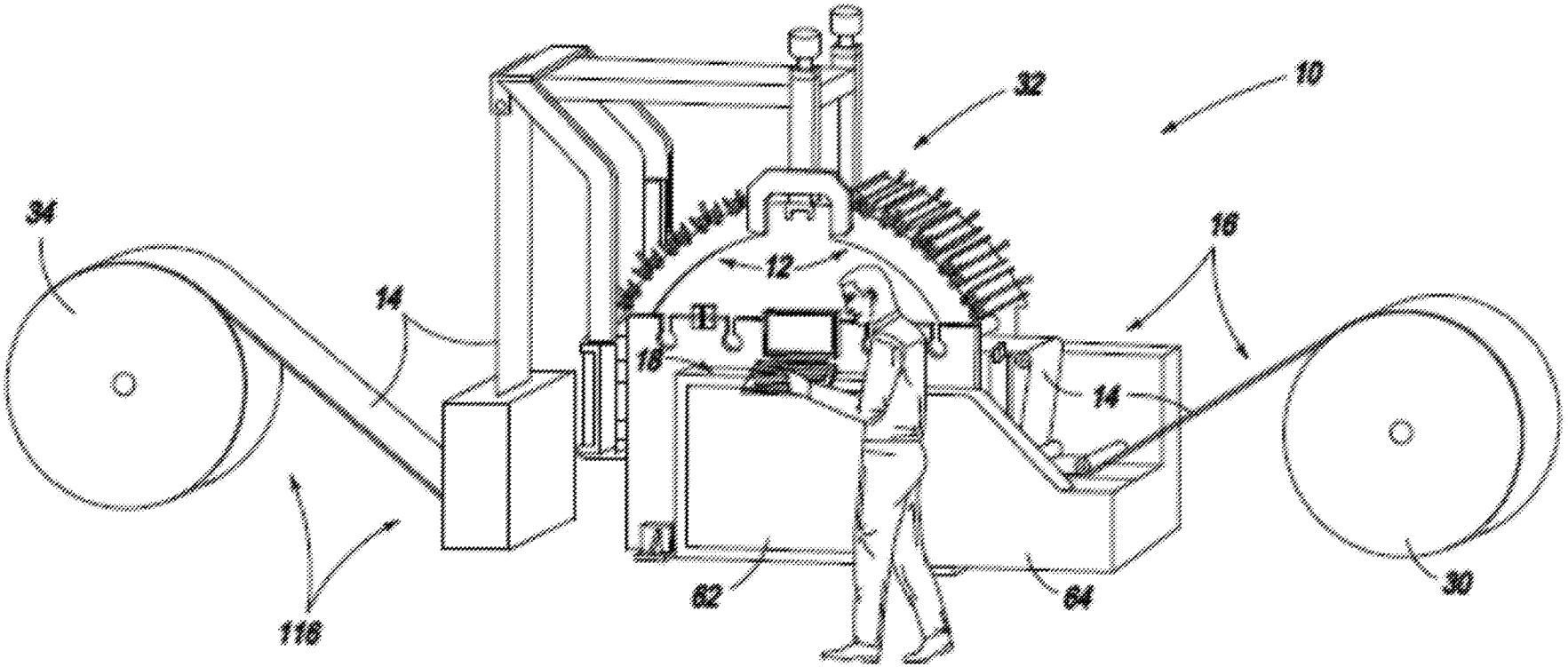
FIG. 2 is a schematic diagram showing a perspective view of a single station inkjet web printer described herein.
Figure 3:
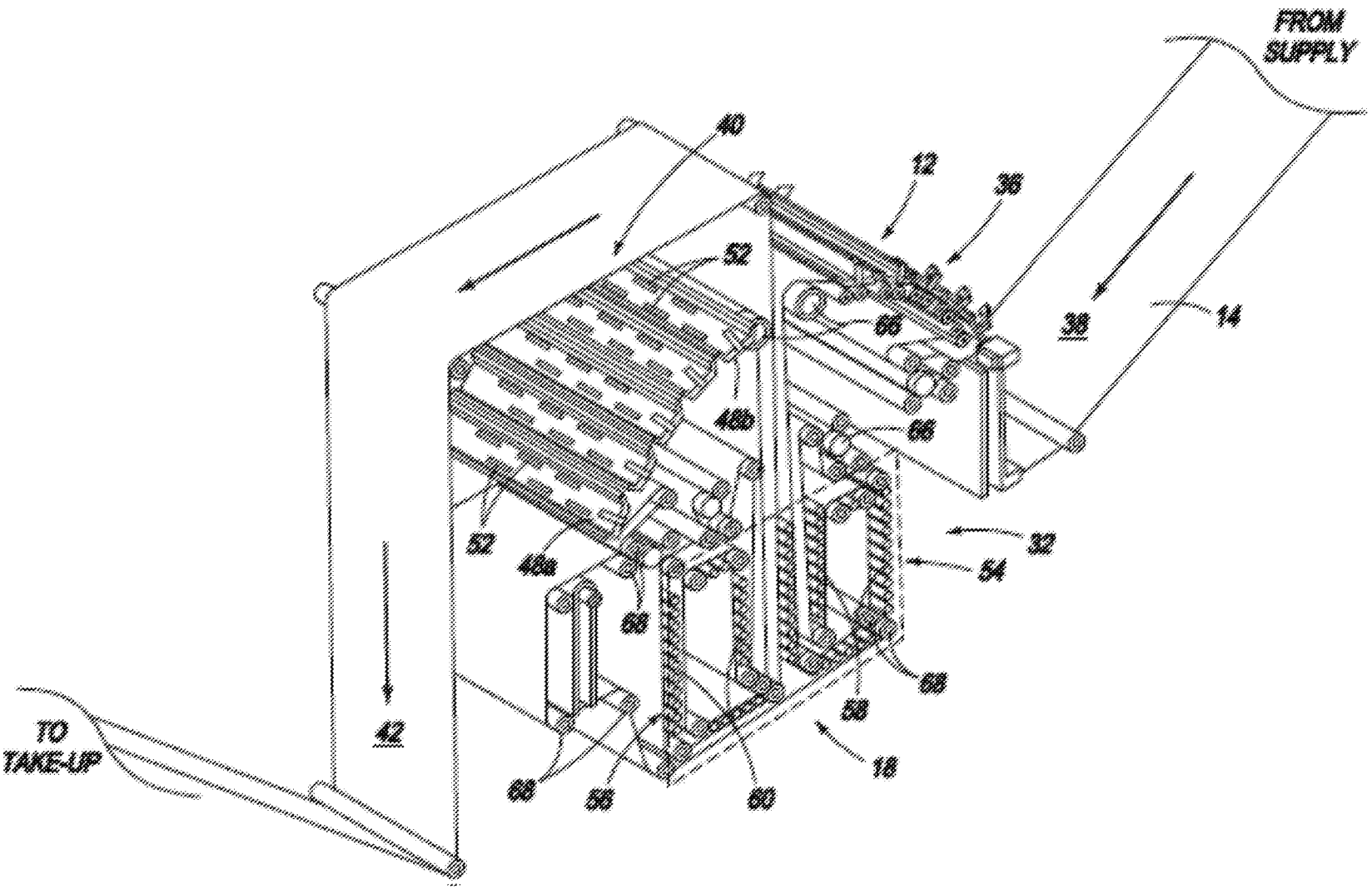
FIG. 3 is a schematic diagram showing a perspective view showing in more detail one example of an arched printing station and duplex web printing path in the printer shown in FIG. 2.
Figure 4:
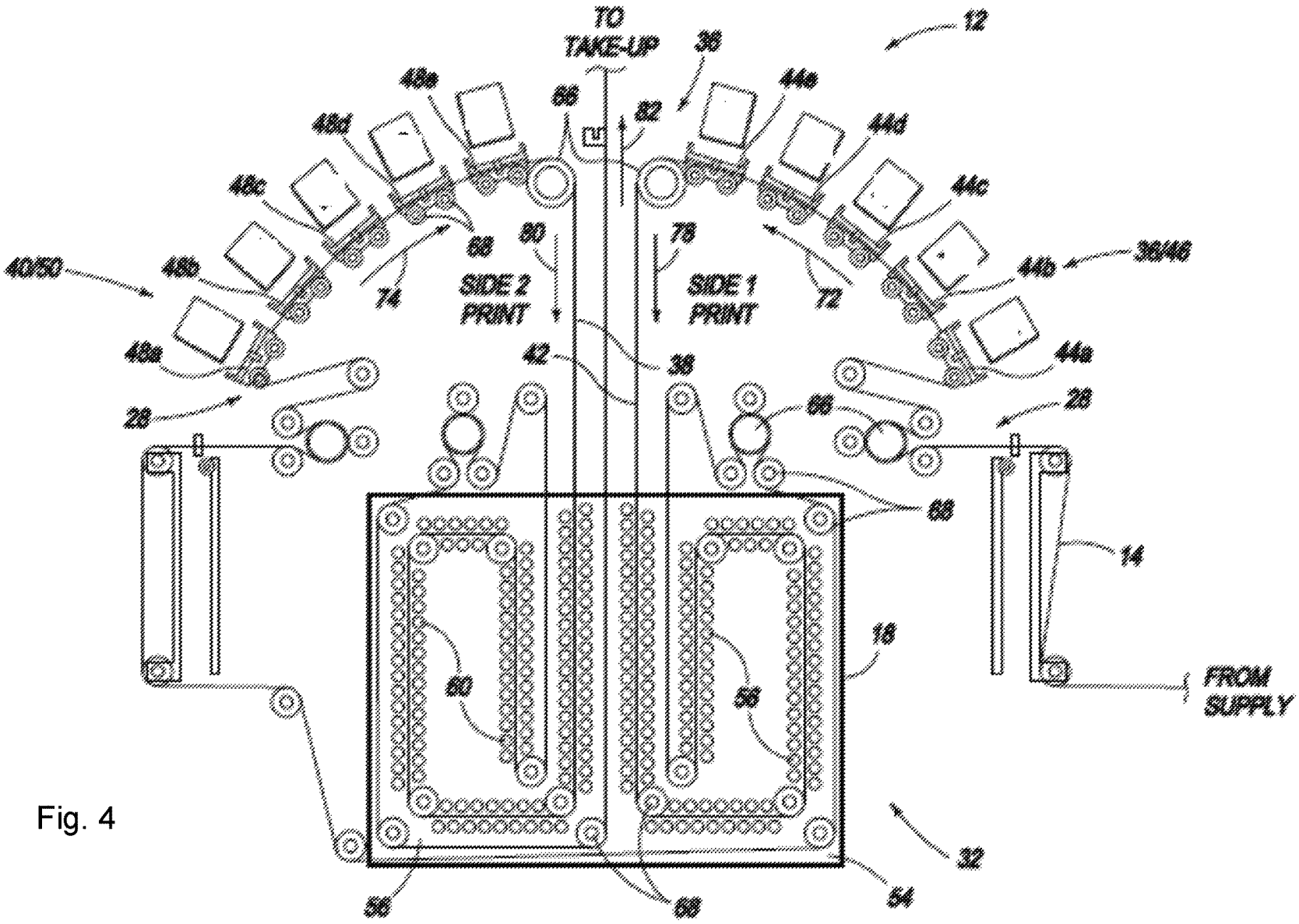
FIGS. 4 and 5 are elevation and perspective views, respectively, illustrating in more detail the duplex web printing path shown in FIG. 3.
Figure 5:
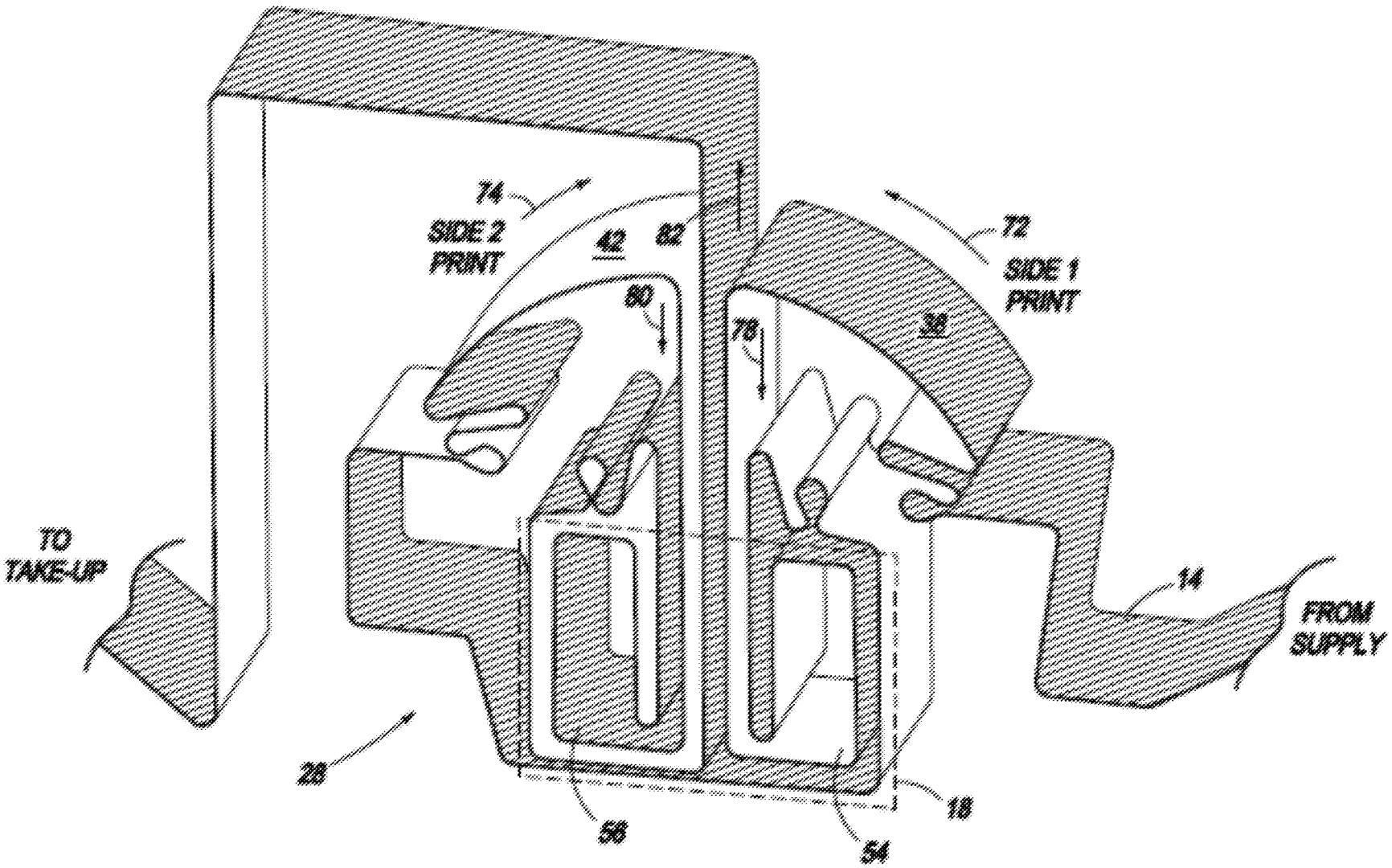

FIG. 2 shows a perspective view illustrating one example single station inkjet web printer 10. FIG. 3 shows a perspective view illustrating in one example an (arched) printing component 12 and a duplex web printing path 28 in the example of printer 10 as shown in FIG. 2. The printing component 12 may be arched as shown in FIG. 3. It is noted that while FIGS. 2 and 3 show specific configurations of a printer, other configurations of the printer may also exist and be suitable. FIGS. 4 and 5 show elevation and perspective views, respectively, illustrating duplex printing path 28 in one example. Referring first to FIG. 2, printer 10 includes a web supply spool 30 from which web 14 is fed to a printing station 32 and a take-up spool 34 onto which web 14 is wound after passing through printing station 32. Referring also to FIGS. 3-5, printing station 32 includes (arched) printing component 12 and a dryer 18 positioned under and contained within the footprint of arched printing component 12. Printing component 12 includes a first printing part 36 for printing on a first side 38 of web 14 and a second printing part 40 for printing on a second side 42 of web 14, when web 14 is fed along duplex printing path 28.

First printing part 36 includes a first series of print bars 44*a*-44*e* arranged along an arc on a first side 46 of printing component 12. Second printing part 40 includes a second series of print bars 48*a*-48*e* arranged along an arc on a second side 50 of printing component 12. In one example arrangement, print bars 44*a*, 44*b*, 48*a* and 48*b* dispense a black ink composition, print bars 44*c* and 48*c* dispense a magenta ink composition, print bars 44*d* and 48*d* dispense a cyan ink composition, and print bars 44*e* and 48*e* dispense a yellow ink composition. Other dispensing configurations are also possible. For example, fewer or more than the number of the print bars as shown may be possible. In one example, instead of the ink composition configuration as shown in FIG. 4, at least one of print bars 44*a*-44*e* and 48*a*-48*e* is to dispense a moisturizing agent, while the remainder of the 44*a*-44*e* and 48*a*-38*e* are to dispense ink compositions. In the example shown in FIGS. 2 and 3, each print bar 44, 48 includes a group of ink pens 52. (Ink pens may be referred to as ink cartridges or printheads.) Ink pens 52 in each print bar 44, 48 may be staggered in a lengthwise direction along web 14 and overlap adjacent pens in a crosswise direction across the width of web 14. The configuration of ink pens 52 on each print bar 44, 48 shown in FIGS. 2-3 is just one example, and other configurations are possible. For other examples, each print bar 44, 48 may include a more linear array of printhead dies or at least one printhead module each holding multiple printhead dies.

The dryer described herein may take any suitable form. For example, the dryer may dry using air (e.g., forced air), radiant heat (e.g., infrared heating ("IR")), or both. In one example, an IR emitter, alone or in combination with a reflector, may be located in a window an air bar, which has an air channel that may ejected air that is heated. At least one of such an air bar may be placed on one or both sides of the print medium so that the heated air (as a result of IR) may be used to dry the medium. In some instances, the IR heat is applied to the medium directly without additional forced air.

Dryer 18 includes a first dryer part 54 for drying web first side 38 and a second dryer part 56 for drying web second side 42. Dryer first part 54 includes a first group of perforated tubes 58 extending across the width of web 14 for directing heated air simultaneously on to both sides 38 and 42 uniformly across the width of web 14. Similarly, dryer second part 56 includes a second group of perforated tubes 60 extending across the width of web 14 for directing heated air simultaneously on to both sides 38 and 42 uniformly across the width of web 14. Some tubes 58 and 60 are not shown in FIG. 3 only for the purpose of showing better web 14 in dryer 18. All of tubes 58 and 60 are shown in FIG. 4. Any suitable perforation(s) in tubes 58 and 60 may be used, including, for example, a single lengthwise slit or a pattern of multiple opening. Heated air is pumped into perforated tubes 58, 60, for example, from a source (not shown) that may be integrated into dryer 18 or external to dryer 18. Dryer 18 may be enclosed in a housing 62 (e.g., FIG. 2) and air removed from housing 62 through exhaust ducting 64 (e.g., FIG. 2).

Although it may be adequate for some printing applications to distribute drying air across only one side 38 or 42, a two sided air drying configuration such as that shown in FIGS. 3-5 may be employed. In one example, air drying allows both sides 38 and 42 of web 14 to be exposed to the heating element (heated air in this case) simultaneously to help expedite drying. Also, applying air to both sides 38 and 42 simultaneously may help support web 14 along the spans between web guides. In the example shown in FIGS. 3-5, web path 28 includes three vertical spans and two horizontal spans through air distribution tubes 58, 60 in each dryer part 54 and 56. Other configurations are possible, for example depending on the size of dryer 18 and the drying capacity of air distribution tubes 58 and 60 (and any other drying elements that might be used).

Referring still to FIGS. 2-5, a series of guide rollers 66 and 68 are arranged to guide web 14 along duplex printing path 28 from supply spool 30 past first print bars 44*a*-44*e* for printing on web first side 38, then through first dryer part 54 for drying web first side 38, then past second print bars 48*a*-48*e* for printing on web second side 42, then through second dryer part 56 for drying web second side 42, and then to take-up spool 34. In the example shown, web guides 66 are driven rollers that also help move web 14 along path 28, and web guides 68 are non-driven rollers (e.g. idler rollers). Web guides 66 and 68 are arranged to contact only second side 42 of web 14 in dryer first part 54 and only first side 38 of web 14 in dryer second part 56.

Unlike a web press that uses a turn bar to invert the web for duplex printing, in one example of duplex printing path 28, the long axis of each web guide 66, 68 is oriented parallel to the long axis of each of the other web guides 66, 68. In this example, web 14 moves past first print bars 44*a*-44*e* along a rising arc in one direction, as indicated by arrows 72 in FIGS. 4 and 5, and past second print bars 48*a*-48*e* also along a rising arc but in the opposite direction, as indicated by arrows 74 in FIGS. 4 and 5. Thus, this example does not involve inverting web 14 on a turn bar for duplex printing, while still realizing the benefits of a smaller footprint, arched printing component 12. Also, as best seen in FIGS. 4 and 5, web 14 travels vertically down to dryer 18 from both printing parts 36 and 40, along a center part 76 of printing component 12 between first printing part 36 and second printing part 40, as indicated by arrows 78 and 80. Web 14 exits printing station 32 in the opposite direction (vertically upward) along this same line as indicated by arrow 82. Thus, a dryer 18 for drying both sides 38 and 42 of web 14 may be fully contained within the footprint of arched printing component 12. It is noted that a dryer need not be within the footprint of the printing component. Rather, in one example a dryer is located outside of the footprint of the printing component modularly.

Other turn bar and paper path configurations are also possible. In one example, a simplex printing system may be employed. In such a simplex printing system, several gears, meter rollers, trolleys, etc. may be strategically placed to provide the desired type of printing needed. The printing may involve, for example, preprint and/or litho laminated ("litholam") (which may involve taking a print medium that has been printed and mounting it onto a corrugated substrate), etc. Examples of simplex printing systems include T400S and T1100S printers, available from HP Inc., USA.

In another example, a duplex printing system may be employed. For example, the printing system may include two printing engines. A larger or a smaller number of printing engines may also be possible. After one side of the print medium is printed, the print medium may be routed through a turn bar, which may flip the paper medium over, whereby the second side of the print medium is printed. Duplex printing is described further below. Examples of duplex printing systems include T400 printers, available from HP Inc., USA.

In one example, the duplex printing path 28 and arched printing station 32 described herein facilitate printing component 12 and dryer 18 to be accessed for service. Full access to print bars 44 and 48, web path 28, and dryer 18 may be gained simply by removing housing covers on the front and/or back sides of printing station 32. Also, in this example the tension in web 14 and its alignment to print bars 44, 48 is much easier to control along an arced web path 28 (at arrows 72, 74 in FIG. 4) than an otherwise flat web path in a vertical stack press. Printing along an arc may provide a stable wrap angle around each print zone guide idler roller 68 for consist high-speed printing. The web wrap on print zone guide rollers 66 may have several benefits, including (1) to help ensure that web 14 rotates each idler roller 68 instead of web 14 dragging across the roller, which could damage the side of web 14 in contact rollers 66 particularly where an image has been formed on the contact side of web 14, (2) to minimize air entrainment between web 14 and print zone idler rollers 66, which could destabilize web 14 and misalign the printed image, and (3) to reduce the risk of a cockled web 14 crashing into a print bar 44, 48 or an ink pen 52.

Figure 6:
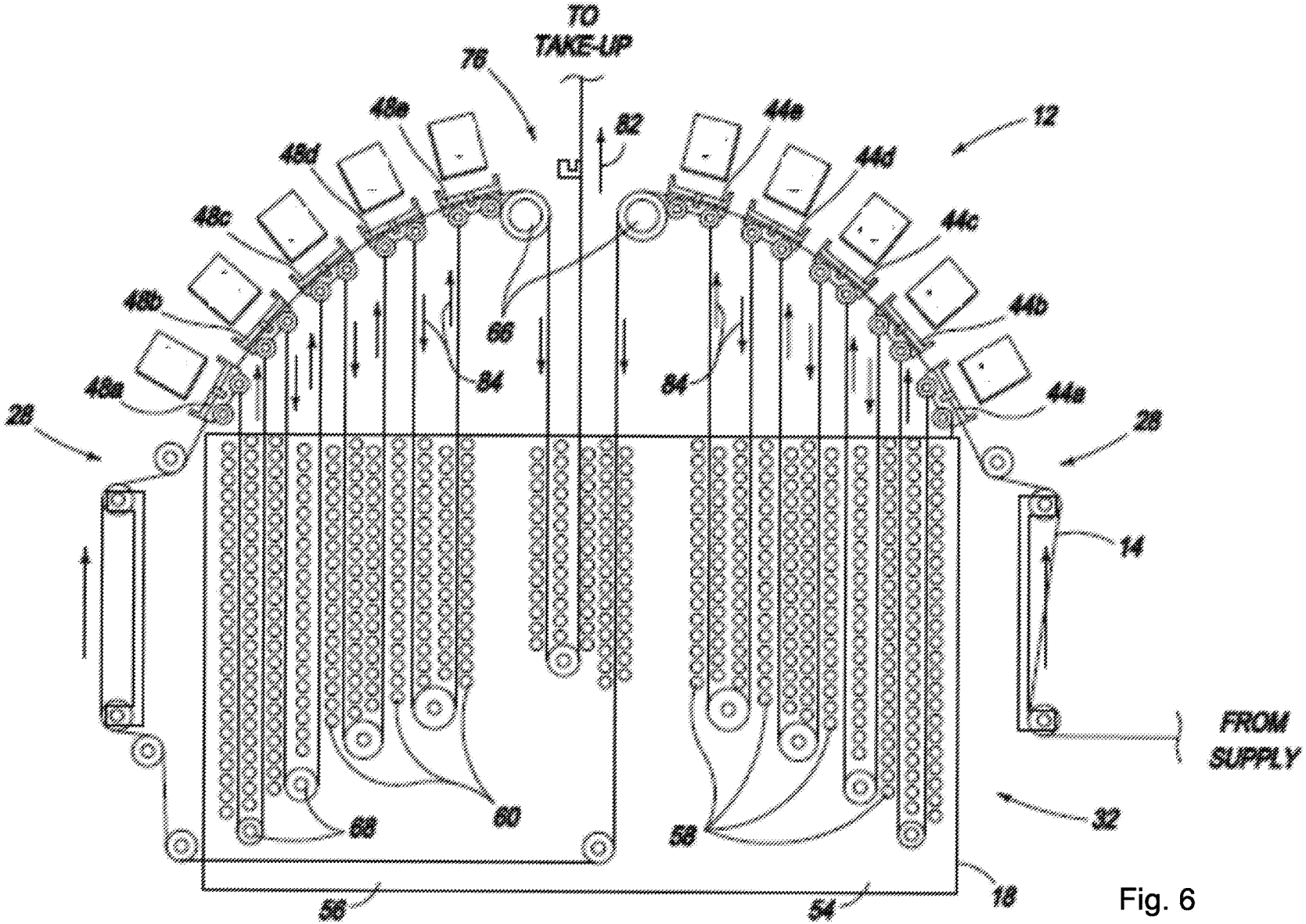
FIG. 6 is an elevation view of one example of a duplex web printing path through the printer shown in FIG. 2 with interstitial drying, in which the web moves through the dryer after passing each print bar.

The duplex printing path 28 and arched printing station 32 described herein may facilitate interstitial drying within the same compact footprint. FIG. 6 is an elevation view of one example of a duplex web printing path 28 with interstitial drying, in which web 14 moves through dryer 18 after passing each print bar 44*a*-44*e* and 48*a*-48*e*. In the example where at least one of the print bars is to dispense a moisturizing agent, the placement of the moisturizing agent dispensing print bar(s) relative to the other print bars need not be of any particular type. An interstitial drying web path 28 as in FIG. 6 may allow immediately drying the ink printed at each print bar, which, for example, may in turn help achieve higher quality printing on less expensive non-porous or closed web media. Referring to FIG. 6, web guides 66 and 68 are arranged to guide web 14 down to dryer 18 after passing each print bar 44*a*-44*e* and 48*a*-48*e* and then back up to printing component 12 past the next print bar 44*a*-44*e* and 48*a*-48*e*, as indicated by arrows 84.

Air distribution tubes 58 and 60 may be arranged along both sides of web 14 in dryer parts 52 and 54. The air support of web 14 afforded by opposing tubes 58, 60 may be beneficial for interstitial drying to allow for longer spans of web 14 between web guides 66, 68. In other examples, it may be desirable to guide web 14 past more than one print bar 44*a*-44*e*, 48*a*-48*e* before drying. Indeed, a number of different configurations for web path 28 are possible without changing the structural configuration of print station 32 by threading web 14 into the desired path. For one example, web 14 could be threaded past both black (K) print bars 44*a*, 44*b* and 48*a*, 48*b* and down to dryer 18, and then past each of the other print bars 44*c*-44*e* and 48*c*-48*e* and down to dryer 18 in succession.

Methods of Printing

Figure 7:
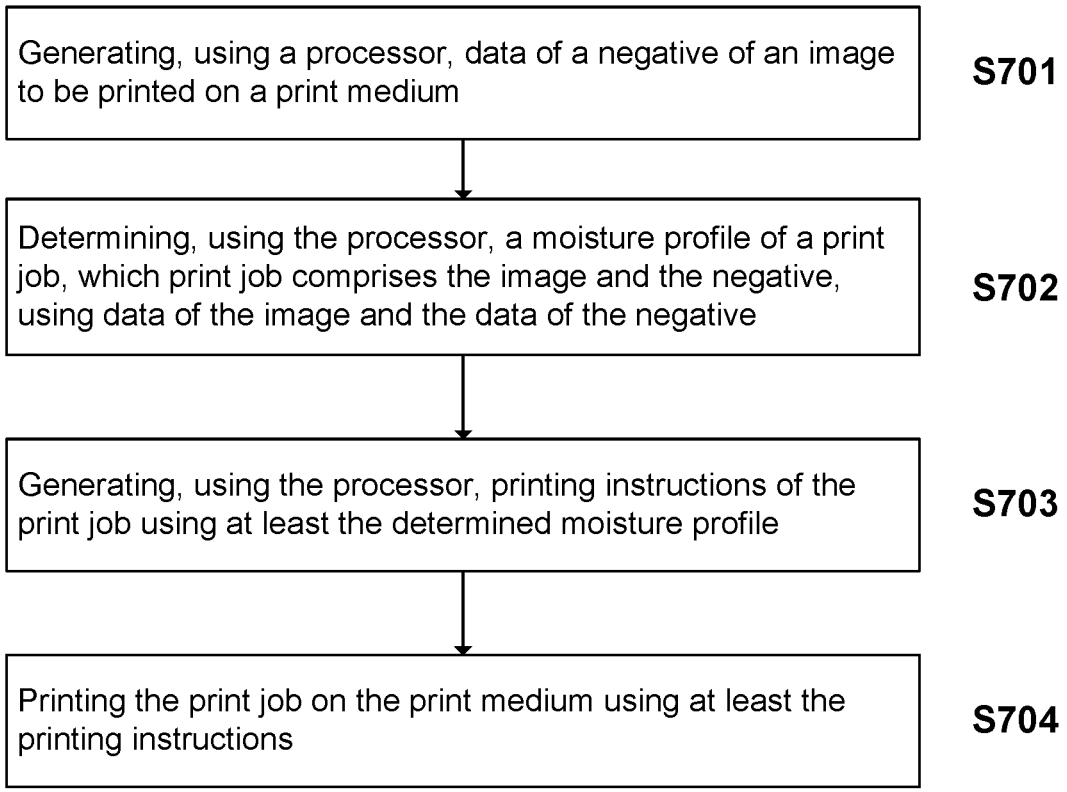
FIG. 7 is a flowchart showing the processes involved in one example method described herein.
Figure 8:
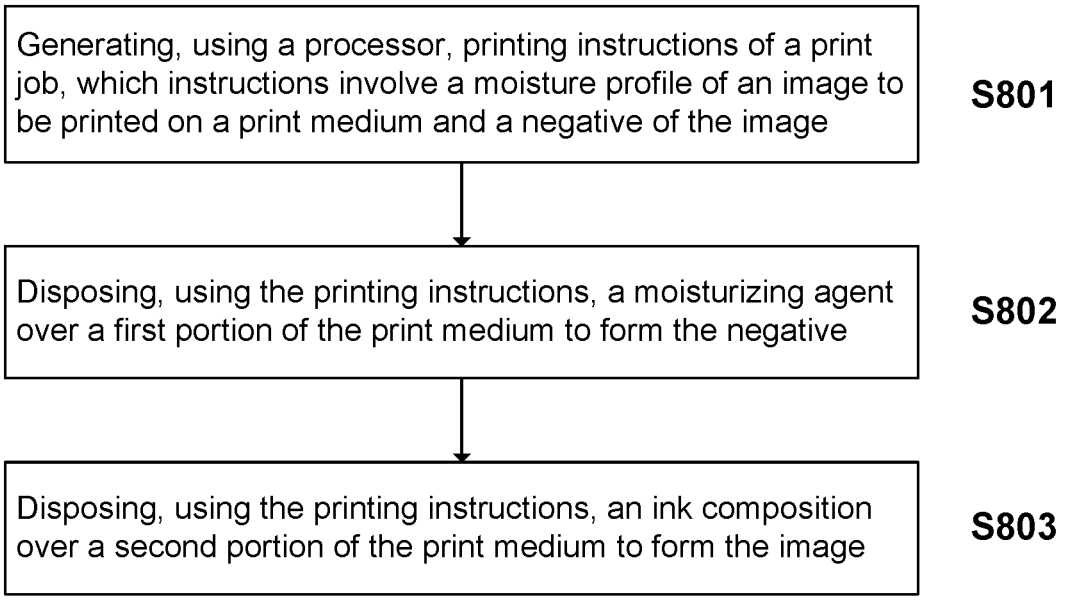
FIG. 8 is a flowchart showing the processes involved in another example method described herein.

The printing devices described herein may be employed to implement various suitable printing methods, including those that involve using a moisture profile. FIGS. 7 and 8 show two examples of printing methods as described herein.

Referring to FIG. 7, the method may comprise generating, using a processor, data of a negative of an image to be printed on a print medium (S701). The data may encompass any relevant information, including color, amount of ink to use, amount of moisture associated with the ink used, etc. The negative may refer to the remaining space on the print medium not occupied by the image.

A print medium may refer to any material suitable for an ink composition to be disposed upon, and the printed ink composition may be used to display a variety of forms and/or images, including text, graphics, characters, images, or photographs. The ink composition that may be employed herein is not limited and may be any aqueous and non-aqueous based ink compositions. A print medium may comprise vinyl media, cellulose-based paper media, various cloth materials, polymeric materials (examples of which include polyester white film or polyester transparent film), photopaper (examples of which include polyethylene or polypropylene extruded on one or both sides of paper), metals, ceramics, glass, or mixtures or composites thereof. In one example, the print medium is a paper, including at least one sheet of paper, a roll of paper, etc.

The processor may be, for example, a computer. It is noted that when any aspect of an example described herein is implemented at least in part as algorithms, the algorithms may be executed on any suitable processor or collection of processors, whether provided in a single computer or distributed among multiple computers. The processor may be employed to perform any suitable functions.

As noted, for example in FIG. 1, machine-readable memory 28 and instructions implemented thereon 281 may be involved. Various examples described herein may be implemented at least in part as a non-transitory machine-readable storage medium (or multiple machine-readable storage media)—e.g., a computer memory, a floppy disc, compact disc, optical disc, magnetic tape, flash memory, circuit configuration in Field Programmable Gate Arrays or another semiconductor device, or another tangible computer storage medium or non-transitory medium) encoded with at least one machine-readable instructions that, when executed on at least one machine (e.g., a computer or another type of processor), cause at least one machine to perform methods that implement the various examples of the technology discussed herein. The computer readable medium or media may be transportable, such that the program or programs stored thereon may be loaded onto at least one computer or other processor to implement the various examples described herein.

As shown in FIG. 7, the method may further comprise determining, using the processor, a moisture profile of a print job, which print job comprises the image and the negative, using data of the image and the data of the negative (S702). The print job may refer to printing of both the image to be printed and the negative of the image. The moisture profile may encompass the moisture levels (due at least in part to the ink composition to be used) of the image and the negative of the image. The method may further comprise generating, using the processor, printing instructions of the print job using at least the determined moisture profile (S703). The instructions may be in the form of machine-readable instructions.

The method may also comprise printing the print job on the print medium using at least the printing instructions (S704). The printing process as shown in FIG. 7 may involve any suitable printing techniques. For example, the printing process may involve disposing a moisturizing agent over a first portion of the print medium to form the negative; and disposing an ink composition over a second portion of the print medium to form the image. The disposing of the moisturizing agent and the disposing of the ink composition may be carried out by the same printing device or by different printing devices.

The moisturizing agent disposed over a portion of the print medium to form the negative may comprise any suitable material. For example, the moisturizing agent may comprise water, including in one example consisting essentially of water, including in one example consisting of water. The water may be tap water, reverse osmosis ("RO") water, deionized ("DI") water, etc. The moisturizing agent may comprise a bonding agent and/or a fixer. The bonding agent may be any suitable agent. For example, the bonding agent may be an aqueous composition. In one example, the bonding agent may comprise a glycol and/or a salt. The glycol may be tetraethylene glycol. The salt may be a metal salt, such as a calcium salt. In one example, the bonding agent comprise less than about 15% glycol, and less than about 10% metal salt, balanced by water. Other compositions are also possible. The % herein may refer to wt % or vol %, depending on the context.

The moisturizing agent may comprise additional components. For example, the moisturizing agent may comprise a biocide, surfactant, humectant, or combinations thereof. Examples of a biocide may include any suitable antibacterial, antifungal, and/or antiviral compositions. Examples of a humectant ma include glycol and Dantocol® by Lonza, USA. Examples of a surfactant may include Tergital™ by Dow Chemical, USA. Other suitable materials may be used for any of the biocide, surfactant, and humectant as described herein. In one example, the moisturizing agent consists essentially of the water and the additional components described herein. In one example, the moisturizing agent consists of the water and the additional components described herein. In one example, the moisturizing agent consists essentially of the bonding agent and the additional components described herein. In one example, the moisturizing agent consists of the bonding agent and the additional components described herein.

FIG. 8 illustrates another method described herein. The method may comprise generating, using a processor, printing instructions of a print job, which instructions involve a moisture profile of an image to be printed on a print medium and a negative of the image (S801). Once the printing instructions are generated, the method may comprise disposing, using the printing instructions, a moisturizing agent over a first portion of the print medium to form the negative (S802). The method may also comprise disposing, using the printing instructions, an ink composition over a second portion of the print medium to form the image (S803).

The method as shown in FIG. 8 may additionally comprise processes involved in the generation of printing instructions. For example, the method as shown in the figure may also comprise generating, using the processor, data of the negative. The method may also comprise determining, using the processor, the moisture profile of the print job comprising the image and the negative, using data of the image and the negative. The method may also comprise generating, using the processor, printing instructions of the print job using at least the determined moisture profile. In one example, the moisture may be applied to the print medium on one side, or both sides.

The methods as described herein may comprise other additional processes. For example, a drying process may be carried out. The drying may be applied to the portions of the print medium comprising the image and the negative, or it may be applied to the entire print medium.

The methods described herein may be implemented using a digital application of moisture from a negative of the printed content. In one example, an inkjet print bar may be employed, as described herein, alone or in combination with a bonding agent and/or a fixer, to jet a moisturizing agent onto a web. The agent may comprise primarily water and/or at least one of biocides, surfactants, and humectants; or comprise bonding agent if a bonding agent is employed. The "image" may be the negative of the printed image extracted from the image processing already happening in the data pipeline. Accordingly, the amount of moisture may be uniform, matching the fill level in the image, and not adding more moisture in that region.

The methods provided here may result in some surprising benefits. For example, the methods described herein may result in the printed content having a uniform moisture content, which is important for corrugation, shrinkage being more predictable, and the overall paper shape from an inkjet web press being better. Uniform moisture and predictable shrinkage in turn may result desirable packaging applications. Applying a more uniform level of moisture to the web during printing may reduce issues with paper shape (e.g., cockle, wrinkles, and creases). It may also result in much more uniform moisture profiles in the paper and predictable shrink post-drying because the unprinted areas are not over-dried. While the addition of the moisture for uniformity may be accomplished using analog methods, in at least one example it is desirable to use a negative of the printed image and digital application of moisture. One benefit of the moisture application may be reduction in overall drying power involved.

It should be appreciated that all combinations of the foregoing concepts (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

The indefinite articles "a" and "an," as used herein in this disclosure, including the claims, unless clearly indicated to the contrary, should be understood to mean "at least one." Any ranges cited herein are inclusive.

The terms "substantially" and "about" used throughout this disclosure, including the claims, are used to describe and account for small fluctuations, such as due to variations in processing. For example, they may refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

What is claimed:

1. A method, comprising:

generating, using a processor, data of a negative of an image to be printed on a print medium;

determining, using the processor, a moisture profile of a print job, which print job comprises the image and the negative, using data of the image and the data of the negative, wherein the moisture profile comprises indicated moisture levels due, at least in part, to an ink composition to be used in the print job;

generating, using the processor, printing instructions of the print job using at least the determined moisture profile; and printing the print job on the print medium using at least the printing instructions.

2. The method of claim 1, wherein the printing further comprises:

disposing a moisturizing agent over a first portion of the print medium to form the negative; and disposing an ink composition over a second portion of the print medium to form the image.

3. The method of claim 1, wherein the printing further comprises:

disposing, using a first printing device, a moisturizing agent over a first portion of the print medium to form the negative; and disposing, using a second printing device, an ink composition over a second portion of the print medium to form the image.

4. The method of claim 1, wherein the printing further comprises disposing a moisturizing agent over a portion of the print medium to form the negative, the moisturizing agent comprising water.

5. The method of claim 1, wherein the printing further comprises disposing a moisturizing agent over a portion of the print medium to form the negative, the moisturizing agent comprising at least one of a biocide, a surfactant, and a humectant.

6. The method of claim 1, wherein the printing further comprises disposing a moisturizing agent over a portion of the print medium comprising the negative, the moisturizing agent comprising a bonding agent comprising glycol.

7. The method of claim 1, further comprising drying the printed print job.

8. A method, comprising:

generating, using a processor, printing instructions of a print job, which instructions involve a moisture profile of an image to be printed on a print medium and a negative of the image;

disposing, using the printing instructions, a moisturizing agent over a first portion of the print medium to form the negative; and disposing, using the printing instructions, an ink composition over a second portion of the print medium to form the image.

9. The method of claim 8, wherein the generating further comprises:

generating, using the processor, data of the negative;

determining, using the processor, the moisture profile of the print job comprising the image and the negative, using data of the image and the negative; and generating, using the processor, printing instructions of the print job using at least the determined moisture profile.

10. The method of claim 8, wherein the moisturizing agent comprises water.

11. The method of claim 8, wherein the moisturizing agent comprises a bonding agent comprising water and at least one of a glycol and a calcium salt.

12. The method of claim 8, wherein the moisturizing agent comprises the moisturizing agent comprising at least one of a biocide and a surfactant.

13. The method of claim 8, further comprising drying the first portion and the second portion of the print medium.

14. The method of claim 8, wherein disposing the moisturizing agent and disposing the ink composition are carried out in two different devices.

15. A printing device, comprising:

a printing component having a first series of print bars arranged along an arc of the printing component, at least one of the print bars is to dispense a moisturizing agent and at least one of the print bar is to dispense an ink composition;

a dryer; and a plurality of web guides, the web guides arranged to guide a web along a duplex printing path past the first series of print bars for printing on a first side of the web, then through the dryer for drying the first side of the web, then past a second series of print bars for printing on a second side of the web, and then through the dryer for drying the second side of the web.

16. The printing device of claim 15, wherein the second series of print bars is arranged along an arc symmetrical with the first series of print bars.

17. The printing device of claim 16, wherein the dryer is arranged underneath an arch formed by the symmetrical arcs of the first and second series of print bars.

18. The method of claim 1, wherein generating the printing instructions of the print job using the determined moisture profile comprises generating instructions to deposit a moisturizer only over a first potion of the print medium corresponding to the negative of the image.

19. The method of claim 18, wherein a quantity of the moisturizer to deposit being determined based on moisture levels of the image to be printed.

20. The method of claim 1, wherein the moisture profile of a first portion of the print job corresponding to the negative is uniform and matched to a fill level of a second portion of the print job corresponding to the image to be printed.

* * * * *